US009532416B2

(12) United States Patent
van den Broeke et al.

(10) Patent No.: US 9,532,416 B2
(45) Date of Patent: Dec. 27, 2016

(54) BLEEDER CIRCUIT CONTROLLER

(71) Applicant: Silergy Corp.

(72) Inventors: Leendert van den Broeke, Malden (NL); Bobby Jacob Daniel, Nijmegen (NL)

(73) Assignee: Silergy Corp., Cayman Islands (GB)

( * ) Notice: Subject to any disclaimer, the term of this patent is extended or adjusted under 35 U.S.C. 154(b) by 0 days.

(21) Appl. No.: 14/564,659

(22) Filed: Dec. 9, 2014

(65) Prior Publication Data

US 2015/0181669 A1 Jun. 25, 2015

(30) Foreign Application Priority Data

Dec. 24, 2013 (EP) ..... 13199557

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
USPC ..... 315/194, 209 R, 185 R, 291
See application file for complete search history.

(56) References Cited

U.S. PATENT DOCUMENTS 5,416,387 A * 5/1995 Cuk ..... H05B 41/282 315/209 R
8,692,479 B2 * 4/2014 Mercier ..... H05B 33/0809 315/185 R
8,803,434 B2 * 8/2014 Hong ..... H02M 5/2573 315/209 R
8,836,226 B2 * 9/2014 Mercier ..... H05B 37/02 315/194
8,896,223 B2 * 11/2014 Wu ..... H05B 33/0818 315/201
2015/0173144 A1 6/2015 van den Broeke et al.

FOREIGN PATENT DOCUMENTS

EP 2 373 124 A1 5/2011
EP 2 608 636 A1 6/2013
WO 2011/013060 A2 2/2011

OTHER PUBLICATIONS

Extended European Search Report for EP Patent Appln. No. 13199557 (Apr. 7, 2014).

* cited by examiner

*Primary Examiner* — Thuy Vinh Tran

(57) ABSTRACT

A bleeder circuit controller (11) configured to control a bipolar junction transistor (10) having a collector (12) configured to be connected to an output of a phase cut dimmer (2) for receiving a bleed current, an emitter (13) for connecting to ground and a base (14), the bleeder circuit controller configured to generate a control signal for controlling the bleed current through the bipolar junction transistor (10) and measure a signal indicative of the current flow through the dimmer (2) and apply a current limit to a base-emitter current flow as a function of the measured signal.

12 Claims, 2 Drawing Sheets

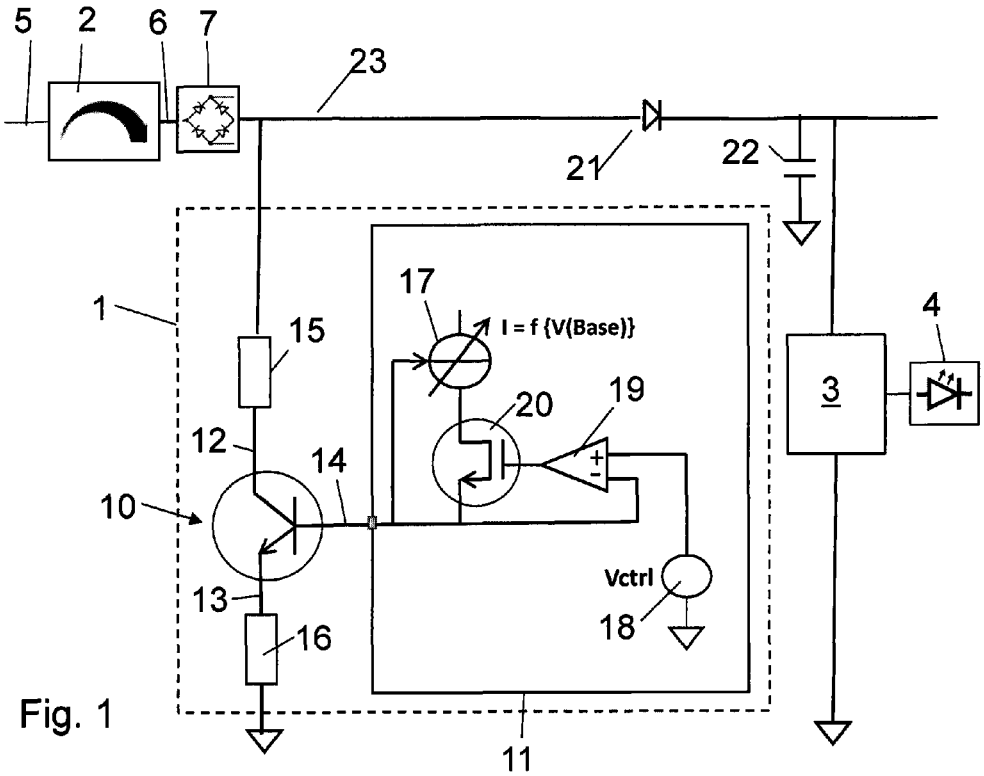
Fig. 1
Fig. 3
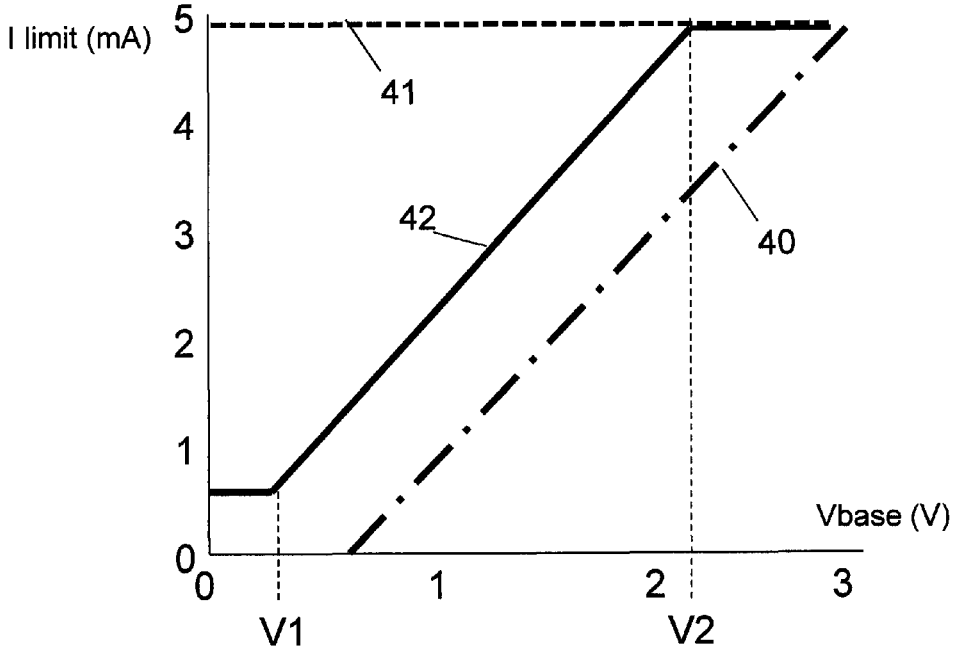

BLEEDER CIRCUIT CONTROLLER

CROSS-REFERENCE TO RELATED APPLICATIONS

This application claims the priority under 35 U.S.C. §119 of European patent application no. 13199557.3, filed on Dec. 24, 2013, the contents of which are incorporated by reference herein.

This invention relates to a bleeder circuit controller for controlling a bipolar junction transistor in a bleeder circuit for use with a phase-cut dimmer. It also relates to a solid state lighting driver including the bleeder circuit controller and a solid state light including the driver and the bleeder circuit controller.

A phase cut dimmer is used to control the current flow to a load, typically for lighting applications. Phase cut dimmers typically include a triac or other switching device for periodically switching between on (conducting) and off (non-conducting) states at a predetermined phase of the applied waveform wherein the ratio of on-state to off-state provides the current flow control. Phase cut dimmers operate reliably with incandescent bulbs but a bleeder circuit may be required for operation with solid state lighting. In solid state lighting, a switched mode power supply is used to drive an LED array, for example, which has a current draw that may not operate reliably with a phase cut dimmer. In particular, a phase cut dimmer may need a minimum load in order to operate correctly. This can be an issue when connected to an efficient dimmable LED. Further, a "latching current" is required to be drawn to complete the transition from off-state to on-state. For LED lighting, a bleeder circuit may be used to pull the whole or part of this current, termed a "bleed current", required for reliable operation of the phase cut dimmer.

According to a first aspect of the invention we provide a bleeder circuit controller configured to control a bipolar junction transistor having a collector configured to be connected to a rectified output of a phase cut dimmer to receive a bleed current, an emitter for connecting to ground and a base, the bleeder circuit controller configured to generate a control signal for controlling the bleed current through the bipolar junction transistor and measure a signal indicative of the current flow through the dimmer and apply a current limit to a base-emitter current flow as a function of the measured signal.

The controller is advantageous as it has been found to reliably control a bipolar junction transistor (BJT) such that it can be used successfully in a bleeder circuit. The use of a BJT in a bleeder circuit is advantageous as they may be more cost effective than MOSFETs used in known bleeder circuits. The determination and application of a current limit as a function of current flow through the dimmer leads to an efficient controller. Thus, the BJT can be controlled such that its current sink capability at the collector adapts to the current through the dimmer to provide an efficient bleed circuit without losing significant drive current into the base of the BJT when it is operating in a saturated mode, for example when the dimmer output voltage is low, such as during the dimmer's non-conduction state. In particular, the BJT may be controlled such that it remains within a linear region of operation or on the edge of saturation and can respond to changes in current flow through the dimmer to adjust the base-emitter current limit through the BJT. Thus, the controller comprises a BJT controller.

The signal measured by the controller may comprise at least one of;

a voltage at the base of the bipolar junction transistor;

a voltage at the emitter of the bipolar junction transistor;

a voltage at the collector of the bipolar junction transistor; and a rectified phase cut mains voltage, the mains voltage comprising the voltage applied to an input of the phase cut dimmer.

It has been found that each of the above voltages can give the controller an indication of the current flow through the dimmer, which can be used to control the limit on the base-emitter current through BJT while allowing for control of the bleed current. The voltages at the base, emitter and collector may be measured relative to ground.

The controller may be configured to control the bipolar junction transistor by applying the control signal at the base for controlling the bleed current from the phase-cut dimmer through the bipolar junction transistor. Control of the current at the base can control the flow of the bleed current from the collector to the emitter.

The controller may include a voltage source and may be configured to control said voltage source to generate said control signal. Thus, the voltage source may be used to control the BJT such that is draws an appropriate bleed current in accordance with a control profile for the particular dimmer and its associated timings.

The controller may include a current source and may be configured to control the current from the current source as a function of the measured signal. Thus, the output of the current source may be dynamically limited in accordance with the function of the measured signal.

The controller may include a switch or transistor configured to control the flow of current from the current source to the base of the bipolar junction transistor. The switch may be integrated in an integrated circuit with the controller.

Alternatively, the base-emitter current may be limited by control of a switch or controllable impedance at the emitter of the BJT. Therefore, the controller may be configured to provide a current limit control signal for controlling the switch connected to the emitter to control the flow of current from the current source to the emitter of the bipolar junction transistor as a function of the measured signal. Thus, rather than controlling the voltage or current to the base of the BJT, one may add a switching element in series between the emitter and ground to control the amount of current flowing from the controller into the base of the BJT. This is advantageous in situations such as when the dimmer current drops by such amount that the BJT would be driven into saturation or in other situations. The switch may comprise a MOS Transistor or a further BJT.

The controller may generate the control signal such that it controls the BJT to draw a bleed current comprising one or more of;

an off-state current during an off-state of the phase-cut dimmer;

a latching current required for a forward phase-cut dimmer to transition between an off-state and an on-state;

a holding current required for a forward phase cut dimmer to maintain the phase-cut dimmer in an on-state once it is in said on-state;

a discharge current for a backward phase cut dimmers to lower the dimmer output voltage low at the transition between an on-state and an off-state.

Thus, the controller may be configured to draw sufficient bleed current as required. A plurality of controllers may be provided for a BJT, each configured to detect when each of the above bleed currents is required and provide a control signal to control the BJT accordingly.

The controller may include an error determination element such as an error amplifier configured to compare the voltage of the control signal with the measured voltage at the base and control the base-emitter current flow using said comparison. The error determination element may be configured to control the current flow to the base.

The BJT may be a low voltage device when combined with a cascaded high voltage metal oxide semiconductor transistor (MOST), the collector of the low voltage BJT connected to the source of the high voltage MOST, the drain of the MOST connected to the rectified mains and the gate to a voltage source.

The base-emitter current flow limit function may comprise a first region in which the current limit increases with the measured signal between a first threshold and a second threshold. The increase may be linear although it could be any other relationship. The function may further include a second region defining a maximum current in which the current limit is held constant when the measured signal exceeds the second threshold.

The function may include a third region in which the current limit is held constant, at an above zero value, while the measured signal is below the first threshold. The measured signal may comprise the voltage at the base.

The function may be configured to limit the base-emitter current such that the controller, when in use, drives the bipolar junction transistor in a linear operation mode substantially on an edge of a saturation mode.

According to a second aspect of the invention, we provide a bleeder circuit comprising a bipolar junction transistor configured to be controlled by the bleeder circuit controller of the first aspect of the invention.

The bleeder circuit may include a user settable component, the bleeder circuit controller configured to use said user settable component to determine the maximum allowable current through the bipolar junction transistor.

The bleeder circuit may include a user replaceable limiting resistor external to the controller and in series with the bipolar junction transistor configured to, in combination with the controller, limit the maximum current through the bipolar junction transistor. The limiting resistor may be located between the emitter and ground.

The controller may be embodied as an integrated circuit (IC). The limiting resistor may be external to the IC.

According to a third aspect of the invention we provide a solid state lighting driver including the bleeder circuit of the second aspect of the invention.

According to a fourth aspect of the invention we provide a solid state light comprising a driver for powering the solid state light, the driver including the bleeder circuit of the second aspect of the invention.

BRIEF DESCRIPTION OF THE DRAWINGS

There now follows, by way of example only, a detailed description of embodiments of the invention with reference to the following figures, in which:

FIG. 1 shows an embodiment of a bleeder circuit in a solid state lighting application; FIG. 3 shows a function of current limit vs. base voltage.

DETAILED DESCRIPTION

Figure 2:
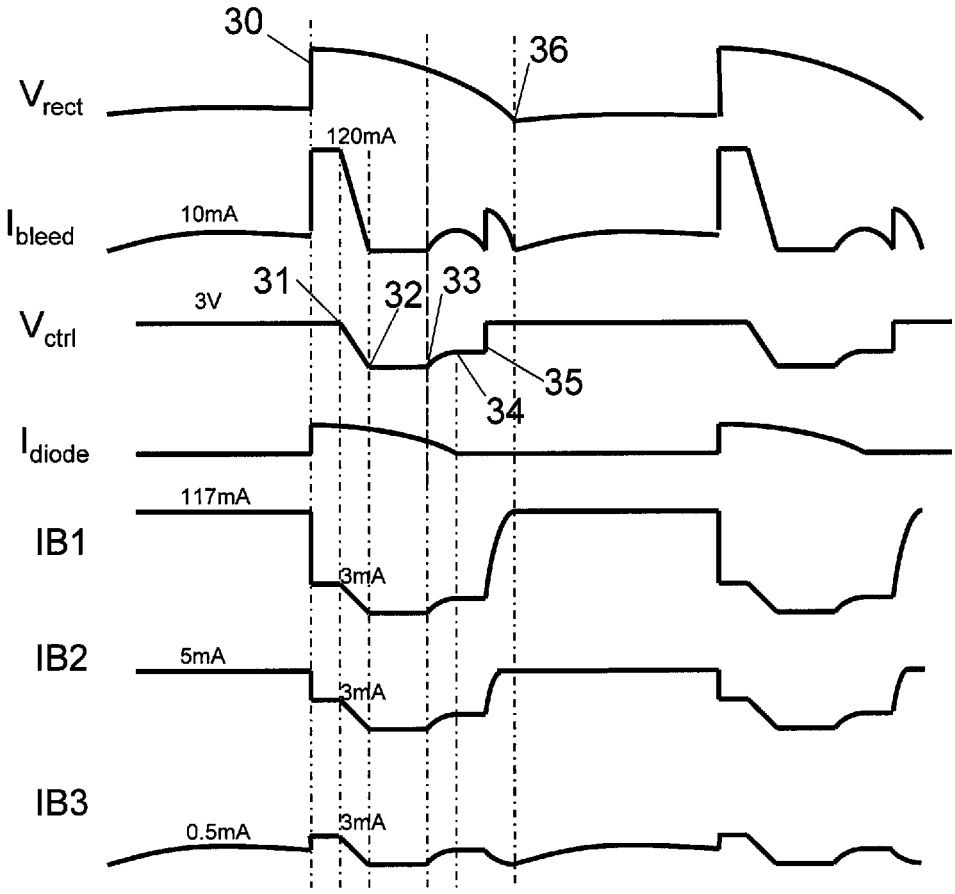
FIG. 2 shows a series of graphs showing waveforms of a rectified output from the phase-cut dimmer, a bleed current profile, the control signal of the controller, the current flow into a driver of a solid state light and three examples of the base-emitter current flow.

FIG. 1 shows a bleeder circuit 1 connected to a phase-cut dimmer 2 via a rectifier 7. The output of the rectifier is also connected to a switched mode power supply 3 which supplies power to a solid state light 4, comprising an LED array. The rectifier 7 is connected to the supply 3 via a diode 21 and is also connected to a buffer capacitor 22. The buffer capacitor 22 serves to buffer input voltage for the supply 3 such that output current can be delivered continuously, and also during the mains zero crossings and dimmer non-conductive time. The diode 21 serves to decouple the output voltage of the rectifier 7 from the buffer voltage across buffer capacitor 22 such that the bleeder circuit 1 can load the dimmer with a current without discharging the buffer capacitor 22.

In other implementations where a high power factor is desired, diode 21 may not be used and the capacitor 22 may have a lower value. In these applications, the supply 3 will only be active while the dimmer 2 is conducting and sufficient rectified mains voltage is available from rectifier 7. It is appreciated that the power supply 3 may be designed to draw current even for low input voltage when the dimmer is not conducting but this generally leads to uncertainty and variation in the amount of energy supplied to the LED load 4 such that a stable light output cannot be guaranteed.

The phase-cut dimmer 2 comprises a mains voltage input 5 for receiving an alternating mains voltage supply and a phase-cut output 6 for outputting a phase-cut output signal as per the setting of the dimmer 2. The dimmer may comprise a forward edge phase cut dimmer or a backward edge phase cut dimmer. The phase-cut signal is rectified by the bridge rectifier 7 and provided to the switched mode power supply 3 and bleeder circuit 1. The bleeder circuit 1 is configured to draw a bleed current when required and of an appropriate size for reliable operation of the phase-cut dimmer 2.

The bleeder circuit 1 includes a bipolar junction transistor (BJT) 10 and a bleeder circuit controller 11. The controller 11 may be embodied as an integrated circuit. The BJT 10 comprises a collector terminal 12, an emitter terminal 13 and a base terminal 14. The controller 11 is connected to the base terminal 14.

The collector terminal 12 is connected to the output of the bridge rectifier 7. A collector resistor 15 is located between the collector terminal 12 and the bridge rectifier 7. The resistor 15 is optional and may be provided to distribute thermal dissipation in the circuit 1 by shifting part of the total bleeder circuit dissipation from the BJT 10 to the resistor. In this way, the dissipation is physically distributed, so reducing cost for the thermal design. The emitter terminal 13 is configured to be connected to ground via an emitter resistor 16.

The controller 11 is configured apply a control signal to the base terminal 14 to control the flow of a bleed current through the BJT 10. Thus, the controller is configured to control the maximum bleed current. For this purpose, a voltage source 18 will be controlled to have a different value over time, depending on the type of dimmer detected by the controller (forward or backward phase cut) and the state of the dimmer (conductive state, non-conductive state, on-off transition, off-on transition). Thus, the bleeder circuit can respond to the operational state of the phase-cut dimmer over each of its cycles to ensure an appropriate bleed current is drawn by the bleed circuit 1 for correct operation of the dimmer 2.

In lighting applications requiring compatibility with phase cut dimmers, current has to be drawn by the load during an off state of the dimmer to ensure that the dimmer functions properly. In addition to this off-state current, a certain "latching current" is required to complete a transition from an off-state to an on-state in the dimmer. Thus the bleeder circuit 1 operates together with the switched mode power supply 3 to draw this bleed current since the supply 3 cannot draw current from the dimmer 2 when it is in an off-state due to diode 21 and capacitor 22.

The controller 11 further includes a variable current source 17 that is configured to set a maximum value of the current that can be supplied to the base terminal 14 as a function of the voltage measured at the base terminal 14. The voltage source 18 is configured to output the control signal that is used to control the bleed current over the dimmer waveform. The voltage source is connected to an error determination element 19. The error determination element 19 receives the control signal at one of its terminals and the measured signal indicative of current flow through the dimmer at its other terminal. In this embodiment the voltage at the base 14 provides the measured signal. The error determination element 19 controls a MOS transistor 20 by way of a connection to its gate, which in turn controls the current flow between the current source 17 and the base 14.

Thus, when the momentary voltage of the rectified mains is high enough to prevent the BJT from saturating (i.e. when the collector voltage is higher than the base voltage), the bleed current will be determined by the output level of the voltage source 18. A voltage drop across the base-emitter junction may be experienced. The voltage drop (Vbe) may be about 0.7V. The bleed current (Ibleed) may therefore be determined by the control signal and the resistance 16 such that Ibleed=(Vctrl−Vbe)/R16 where R16 is the resistance of emitter resistor 16. In this mode of operation, error determination element 19, acts as an error amplifier and together with transistor 20 it functions as a unity gain voltage buffer.

If the collector voltage drops below the base voltage the BJT saturates and the base current increases compared to that in the non-saturated mode of operation. So, without the current limit and if the controller would be capable of supplying an unlimited output current, a high current would flow from the internal IC supply of the controller to the base of the BJT. This is undesired for reason of inefficiency.

Thus, the controller is configured to limit the maximum current that can be conducted via transistor 20 into the base 14 of the BJT 10. The limit on the current is set via current source 17 and is dependent on the measured signal indicative of current flow through the dimmer. In general, the measured signal comprises a measurement of current flow through the bleeder current. Ideally, the current limit is to be set to the value (or just above) of the actual dimmer current divided by the current gain factor (denoted by Hfe) of the BJT. In practice, a margin is taken into account to cover BJTs that have a lower Hfe than average. In this embodiment, as mentioned above, the base voltage is used as the measured signal and an appropriate function is determined.

FIG. 2 shows an example of the voltages and current waveforms for a forward phase cut dimmer. $V_{rect}$ is the rectified voltage from the rectifier 7, such as at point 23. During a dimmer conduction period, the waveform is a phase cut sinusoidal mains voltage. During a dimmer non-conduction period, the voltage is low (typically a few volts) but not exactly zero, as will be appreciated by those skilled in the art. $I_{Diode}$ is the current through diode 21 that flows for part of the cycle to charge the buffer capacitor 22.

$I_{bleed}$ shows an example bleeder current profile that may be used. Such a bleed current profile is achieved by control of the voltage "Vctrl" comprising the output from voltage source 18, as will be described below. Thus, Vctrl comprises the control signal from voltage source 18.

IB1 is the resulting base current if the base current is solely determined by voltage source 18 without using the current limit function provided by current source 17. IB2 is the resulting base current if a fixed current limit is used, in this example 5 mA. IB3 is the base current when using the controller 1 as described in the above embodiment.

Prior to point 30, the dimmer 2 is in a non-conduction state and the voltage at 23 is low. For an optimal behaviour of the phase cut dimmer 2, the bleeder circuit 1 is required to keep the voltage low. This is achieved by the controller 11 setting Vctrl to a predetermined maximum value, which in this example is 3V. Thus, during the non-conduction period, the control signal voltage is set to an upper value.

The BJT 10 will try to draw a high emitter current due to the high control signal voltage setting but the voltage at 23 is low so the BJT 10 has a low collector 12 voltage and it will operate in saturated mode, resulting in a current flow though the bleeder circuit 1 that is determined by the impedance of the dimmer in non-conduction state. Obviously, in this interval, the precise waveform of IBleed depends on the construction of the dimmer. In such a saturated mode, rest of the BJT emitter current is supplied by the base-emitter current which would, in the absence of the current limit, be determined by the output of voltage source 18, Vctrl, and emitter resistor 16 and would be drawn by the base of the BJT 10 and supplied through the transistor 20. The operation of the current limit will be described in more detail below.

At point 30, the dimmer starts its conduction phase. It is noted, that as soon as Vrect has stepped to a high value at the start of the conduction period, the base current IB1 drops significantly (by a factor equal to the BJT 10 current gain Hfe) because the operation mode of the BJT10 has changed from saturated to non-saturated. The bleeder circuit 1 is initially configured to try and keep the voltage at 23 low as this will help the dimmer to latch. When the controller 11 has detected that the dimmer has started conducting, i.e at point 31, and therefore that the current to the supply 3 via diode 22 is high enough to keep the dimmer conducting, the controller 11 is configured to ramp down the control signal, Vctrl.

Vctrl is regulated from point 32 onwards to the value required to keep the dimmer conducting. In this particular example, the Idiode current is higher than the holding current between 32 and 33, hence Vctrl is lowered to a level such that the bleed current Ibleed is zero.

From point 33 onwards, the current $I_{diode}$ is lower than the current required to keep the dimmer conducting (known as the holding current). The controller 11 is configured to gradually increase the voltage Vctrl of voltage source 18 such that the bleeder current complements the decreasing current through diode 22 to the required level. The BJT 10 operates in non-saturated mode.

At point 34, the diode current $I_{diode}$ has become zero. The control signal Vctrl is therefore constant to provide the holding current and the bleed current IBleed stabilizes to a fixed value.

Starting from point 35, shortly before the mains zero crossing, the controller is configured to set Vctrl high thus placing the bleeder circuit in "high current mode", such that it is prepared to keep the voltage 23 low during the subsequent non-conduction period starting at point 36.

At point 35, the voltage 6 has dropped to a level where the BJT would again start to operate in saturated mode. As result, the base-emitter current IB1 would typically increase to a high value as shown in graph IB1. This is undesired because the current would come from a controller supply and so reduce power efficiency (regardless of supply arrangement). Thus, limiting the base-emitter current as a function of the base voltage allows the control signal to control the BJT to provide an effective bleeder circuit while limiting the base-emitter current at least when the dimmer is in a non-conduction period.

In a first example, the base current can be limited by setting the current source 17 to a fixed maximum value that is high enough to enable the controller to control the BJT to achieve the maximum desired bleeder current (120 mA in this example). For example, if the current gain Hfe of the BJT is at least 25, a current limit of about 5 mA is appropriate.

In a preferred example, the base current is controlled based on the measured bleeder circuit 1 current, which is indicative of the current through the dimmer 2. This is achieved by measuring the base voltage and setting the current limit according to the function of FIG. 3. In this example, the bleeder circuit current during the non-conduction period may be 10 mA. If we assume a worst-case current gain, Hfe, of for example 25, the base current can be limited to 0.4 mA. However, it is advantageous to set the maximum current limit higher than this for reliable operation. Thus, in this example, there is current limit margin included and the base current as shown in IB3 can be limited to a peak of 0.5 mA during the non-conduction period.

This control scheme enables the bleeder circuit to transition from pre-30 to post-30 region (off, non-conduction state to conduction-state of dimmer) without requiring a state-change detection or a change of the control voltage (Vctrl).

The operational principles described above for a forward phase cut dimmer apply equally to backward phase cut dimmers, with the necessary timing and magnitudes amended accordingly.

FIG. 3 shows an example of how the current limit set by current source 17 can be controlled depending on the voltage at the base 14. The dashed line 40 shows the minimum current that needs to be available as function of the base voltage in order to drive the bleed current for a BJT 10 with a current gain, Hfe, of 25 and an emitter resistor 16 of, for example, 18 Ohms, while the BJT 10 is operating in an unsaturated mode. The dotted line 41 is the base current limit set by the current source 17 in the example where a static maximum current value of 5 mA is used. The solid line 42 shows an example current limit control function. The line 42 must be above the minimum current line 40 but for optimal efficiency, the current limit control function 42 should still be relatively close to the required minimum 40. Thus the current control function includes a first region in which the current limit increases with the measured variable, which in this example is the voltage at the base, between a first threshold V1 and a second threshold V2. In this example, the current limit function increases linearly in the first region. The control function, in this example, has a second region defining a current maximum in which the current limit is held constant above the second threshold V2. The current control function may further include a third region in which the current limit is held constant, at an above zero value, while the base voltage is below the first threshold V1.

The invention claimed is:

1. A bleeder circuit controller configured to control a bipolar junction transistor having a collector configured to be connected to a rectified output of a phase cut dimmer to receive a bleed current, an emitter for connecting to ground, and a base, the bleeder circuit controller being configured to generate a control signal to control the bleed current through the bipolar junction transistor, to measure a signal indicative of the current flow through the dimmer, and to apply a current limit to a base-emitter current flow as a function of the measured signal, wherein the function comprises a first region in which the base-emitter current limit increases with the measured signal between a first threshold and a second threshold.

2. The bleeder circuit controller of claim 1, wherein the signal indicative of the current flow through the dimmer comprises at least one of:

a voltage at the base of the bipolar junction transistor;

a voltage at the emitter of the bipolar junction transistor;

a voltage at the collector of the bipolar junction transistor; and a rectified phase cut mains voltage, the mains voltage comprising the voltage applied to an input of the phase cut dimmer.

3. The bleeder circuit controller of claim 1, wherein the controller is configured to control the bipolar junction transistor by applying the control signal at the base for controlling the bleed current from the phase-cut dimmer through the bipolar junction transistor.

4. A bleeder circuit controller as defined in claim 3, further comprising a voltage source that is configured to generate said control signal.

5. The bleeder circuit controller of claim 3, wherein the controller is configured to control the current of the control signal as a function of the measured signal to provide said current limit.

6. The bleeder circuit controller of claim 5, wherein the controller comprises a transistor configured to control the flow of current to the base of the bipolar junction transistor.

7. The bleeder circuit controller of claim 5, wherein the controller is configured to provide a current limit control signal for controlling a controllable impedance connected to the emitter to control the flow of current from the controller to the base of the bipolar junction transistor.

8. The bleeder circuit controller of claim 1, wherein the control signal generated by the controller is configured to control the bleed current to provide:

an off-state current during an off-state of the phase-cut dimmer;

a latching current required for the phase-cut dimmer to transition between an off-state and an on-state;

a holding current required to maintain the phase-cut dimmer in an on-state once it is in said on-state; and a discharge current for backward phase cut dimmers to pull the dimmer output voltage low at the transition between an on-state and an off-state.

9. The bleeder circuit controller of claim 1, wherein the controller comprises an error determination element configured to compare a voltage of the control signal with a measured voltage at the base and control the base-emitter current flow using said comparison.

10. The bleeder circuit controller of claim 1, wherein the function further comprises a second region defining a maximum current in which the current limit is held constant when the measured signal exceeds the second threshold.

11. The bleeder circuit controller of claim 1, wherein the function is configured to limit the base-emitter current such that the controller, when in use, drives the bipolar junction transistor in a linear operation mode substantially on an edge of a saturation mode.

12. The bleeder circuit controller of claim 1, wherein the bipolar junction transistor is arranged to be cascaded with a metal oxide semiconductor (MOS) transistor, the collector of the bipolar junction transistor being connected to a source of MOS transistor, the drain of the MOS transistor being connected to a rectified mains signal, and the gate of the MOS transistor being connected to a fixed voltage source.

* * * * *